US008786209B2

(12) United States Patent
Takahashi

(10) Patent No.: US 8,786,209 B2
(45) Date of Patent: Jul. 22, 2014

(54) LIGHT-EMITTING DEVICE AND METHOD OF DRIVING LIGHT-EMITTING DEVICE

(71) Applicant: Semiconductor Energy Laboratory Co., Ltd., Kanagawa-ken (JP)

(72) Inventor: Kei Takahashi, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

(21) Appl. No.: 13/705,895

(22) Filed: Dec. 5, 2012

(65) Prior Publication Data

US 2013/0147365 A1 Jun. 13, 2013

(30) Foreign Application Priority Data

Dec. 9, 2011 (JP) ..... 2011-269719

(51) Int. Cl.
*H05B 37/02* (2006.01)

(52) U.S. Cl.
USPC ..... 315/294; 315/291; 315/307; 315/247; 315/312; 315/158; 345/204; 345/205; 345/207; 345/77; 345/690

(58) Field of Classification Search
CPC .... H05B 37/02; H05B 33/08; H05B 33/0815; H05B 33/0842; H05B 33/0845; G09G 3/30; G09G 3/3241; G09G 3/342
USPC ..... 315/149, 151, 158, 250, 291, 294, 297, 315/307, 224, 247, 169.3, 312; 345/76, 77, 345/81, 84, 102, 204, 205, 207, 690
See application file for complete search history.

(56) References Cited

U.S. PATENT DOCUMENTS

| | | | | |
|---|---|---|---|---|
| 6,774,578 | B2 | 8/2004 | Tanada | |
| 6,903,516 | B2 | 6/2005 | Tanada | |
| 6,995,753 | B2 | 2/2006 | Yamazaki et al. | |
| 7,218,298 | B2 | 5/2007 | Yamazaki et al. | |
| 7,268,499 | B2 | 9/2007 | Tanada | |
| 7,307,607 | B2 | 12/2007 | Osame et al. | |
| 7,510,300 | B2 * | 3/2009 | Iwauchi et al. | 362/231 |
| 7,546,032 | B2 * | 6/2009 | Kita | 396/182 |
| 7,688,290 | B2 | 3/2010 | Yamazaki et al. | |

(Continued)

FOREIGN PATENT DOCUMENTS

JP 2010-177048 8/2010

OTHER PUBLICATIONS

Han, J.-H. et al., "OLED Compensation for OLED Lighting Panel Using Waveguided Light Sensing Method," EURODISPLAY '11: The 31st International Display Research Conference, Sep. 19, 2011, (2 pages).

*Primary Examiner* — Haiss Philogene
(74) *Attorney, Agent, or Firm* — Husch Blackwell LLP

(57) ABSTRACT

Reduction of luminance dispersion of a plurality of light-emitting panels combined into one light-emitting device is achieved by the use of a new light-emitting device which has a photosensor, a plurality of light-emitting panels, DC/DC converters connected to their respective light-emitting panels, and a control circuit configured to control output currents of the DC/DC converters in accordance with illuminance data acquired with the photosensor. The control circuit successively turns on the plurality of light-emitting panels, and controls the output currents of the DC/DC converters in accordance with differences of the illuminance data acquired with the photosensor when the light-emitting panels are turned on.

20 Claims, 10 Drawing Sheets

(56) References Cited

U.S. PATENT DOCUMENTS

| | | | | |
|---|---|---|---|---|
| 7,786,958 | B1 | 8/2010 | Koyama | |
| 7,830,370 | B2 | 11/2010 | Yamazaki et al. | |
| 7,956,854 | B2 * | 6/2011 | Hashimoto | 345/204 |
| 8,013,472 | B2 * | 9/2011 | Adest et al. | 307/77 |
| 8,253,662 | B2 | 8/2012 | Yamazaki et al. | |
| 8,264,452 | B2 * | 9/2012 | You et al. | 345/102 |
| 8,637,802 | B2 * | 1/2014 | Kamata | 250/214.1 |
| 2008/0170007 | A1 | 7/2008 | Tanada | |
| 2010/0188846 | A1 | 7/2010 | Oda et al. | |
| 2010/0321281 | A1 | 12/2010 | Koyama | |
| 2011/0080089 | A1 * | 4/2011 | Hara et al. | 313/504 |
| 2011/0249036 | A1 * | 10/2011 | Kim | 345/690 |

* cited by examiner

LIGHT-EMITTING DEVICE AND METHOD OF DRIVING LIGHT-EMITTING DEVICE

BACKGROUND OF THE INVENTION

1. Field of the Invention

The present invention relates to a light-emitting device, particularly to a light-emitting device applicable to lighting. The present invention also relates to a method of driving a light-emitting device.

2. Description of the Related Art

Light-emitting devices utilizing electroluminescent (EL) elements are being expected to find wider applications in lighting because they have low power consumption and can emit light uniformly from a planar surface.

A light-emitting device employing an EL element for lighting is disclosed in Patent Document 1. Patent Document 1 discloses a structure in which light adjustment can be controlled in accordance with the environment or the place where a plurality of light-emitting panels is used in combination.

REFERENCE

Patent Document 1: Japanese Published Patent Application No. 2010-177048

SUMMARY OF THE INVENTION

A problem of a light-emitting device using an EL element is that luminance differs among a plurality of light-emitting panels combined into one light-emitting device. Such luminance dispersion results from the difference in characteristics among the light-emitting panels which are generated during the manufacturing process; thus, the degree of the dispersion also varies among the light-emitting devices. Therefore in the case where a plurality of light-emitting panels is combined into one light-emitting device, it is difficult to estimate deviation of luminance of the light-emitting panels in advance.

In view of the foregoing, an object of one embodiment of the present invention is to provide a light-emitting device which includes a plurality of combined light-emitting panels having a small luminance dispersion.

One embodiment of the present invention is a light-emitting device which includes a photosensor, a plurality of light-emitting panels, a plurality of DC/DC converters each connected to a corresponding one of the plurality of light-emitting panels, and a power control circuit configured to control output currents of the plurality of DC/DC converters in accordance with illuminances acquired with the photosensor. In the light-emitting device, the power control circuit successively turns on the plurality of light-emitting panels, and controls the output currents of the plurality of DC/DC converters in accordance with a dispersion of the illuminances acquired with the photosensor when the plurality of light-emitting panels is turned on.

One embodiment of the present invention is a light-emitting device which includes a photosensor, a plurality of light-emitting panels, a plurality of DC/DC converters each connected to one of the plurality of light-emitting panels, and a power control circuit configured to control output currents of the plurality of DC/DC converters in accordance with illuminances acquired with the photosensor. In the light-emitting device, the power control circuit acquires an external light illuminance, successively turns on the plurality of light-emitting panels in accordance with the external light illuminance, and controls the output currents of the plurality of DC/DC converters in accordance with a dispersion of the illuminances acquired with the photosensor when the plurality of light-emitting panels is turned on.

In one embodiment of the present invention, the light-emitting device preferably includes a plurality of photosensors.

In one embodiment of the present invention, each of the light-emitting panels in the light-emitting device preferably includes an EL element.

One embodiment of the present invention is a method of driving a light-emitting device, which includes the following successive steps: generating a reference current with a power control circuit in accordance with an external environment; supplying the reference current from any one of a plurality of DC/DC converters to a corresponding one of a plurality of light-emitting panels; acquiring an illuminance with a photosensor when light is emitted from each light-emitting panel supplied with the reference current; and successively controlling, with a current control circuit, output of a corrected current that is obtained in accordance with the illuminance acquired with the photosensor and to be supplied from any one of the DC/DC converters to the light-emitting panel electrically connected to the DC/DC converter.

One embodiment of the present invention is a method of driving a light-emitting device, which includes the following successive steps: estimating an external light illuminance, with a photosensor; generating a reference current with a power control circuit in accordance with the external light illuminance; supplying the reference current from any one of a plurality of DC/DC converters to a corresponding one of a plurality of light-emitting panels; acquiring an illuminance with a photosensor when light is emitted from each light-emitting panel supplied with the reference current; and successively controlling, with a current control circuit, output of a corrected current that is obtained in accordance with the illuminance acquired with the photosensor and to be supplied from any one of the DC/DC converters to the light-emitting panel electrically connected to the DC/DC converter.

In accordance with one embodiment of the present invention, luminance dispersion among the plurality of light-emitting panels combined into one light-emitting device can be reduced.

DETAILED DESCRIPTION OF THE INVENTION

Figure 1:
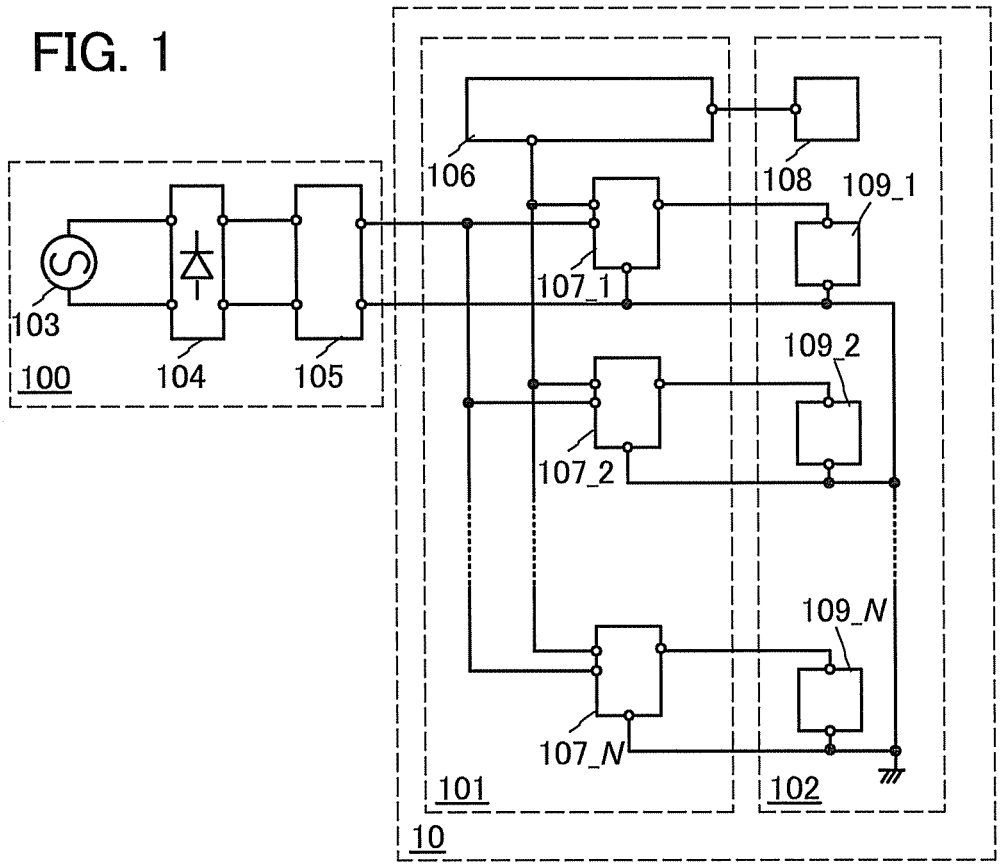
FIG. 1 is a block diagram illustrating a configuration in Embodiment 1.

Hereinafter, embodiments of the present invention will be described with reference to the accompanying drawings. However, the present invention can be carried out in many different modes, and it is easily understood by those skilled in the art that modes and details of the present invention can be modified in various ways without departing from the purpose and the scope of the present invention. Therefore the present invention should not be construed as being limited to the following description of the embodiments. Note that in structures of the present invention described below, reference numerals denoting the same portions are used in common in different drawings.

Note that the size of components and the thickness of layers illustrated in the drawings of the embodiments and the like are exaggerated in some cases for simplicity. Therefore, the scale is not necessarily limited to that illustrated in the drawings and the like.

Note that in this specification, the terms "first", "second", "third", and "N-th" (N is a natural number) are used in order to avoid confusion between components and thus do not limit the number of the components.

Embodiment 1

In this embodiment, a light-emitting device and a method of driving a light-emitting device in accordance with one embodiment of the present invention are described.

A block diagram of a light-emitting device 10 is shown in FIG. 1. In FIG. 1, the light-emitting device 10 includes a light emission control unit 101 and a light-emitting unit 102. The light emission control unit 101 of the light-emitting device 10 is connected to a power supply unit 100 including an AC power supply 103.

The power supply unit 100 includes a rectifier circuit 104 and an AC/DC converter 105 in addition to the AC power supply 103. Note that the rectifier circuit 104 and the AC/DC converter 105 are present outside the light-emitting device 10 in the example in FIG. 1 but may be included in the light-emitting device 10. When a DC power supply is used instead of the AC power supply 103, the rectifier circuit 104 and the AC/DC converter 105 are not necessary in the power supply unit 100.

The light emission control unit 101 includes a power control circuit 106 and a first DC/DC converter 107_1 to an Nth DC/DC converter 107_N (N is a natural number greater than or equal to 2).

The light-emitting unit 102 includes a photosensor 108 and a first light-emitting panel 109_1 to an Nth light-emitting panel 109_N.

The rectifier circuit 104 is a circuit for rectifying an AC voltage output from the AC power supply 103 to give a DC voltage. The rectifier circuit 104 is formed using a diode element, for example. When formed using a diode element, the rectifier circuit may be a full-wave rectifier circuit, a half-wave rectifier circuit, a circuit using a diode bridge, a full-wave rectifier circuit using a transformer, or the like.

The AC/DC converter 105 is a circuit for converting the AC voltage rectified by the rectifier circuit 104 into a DC voltage. The AC/DC converter 105 is formed using a switching element or a capacitor, for example.

The power control circuit 106 is a circuit for individually controlling currents output from the first DC/DC converter 107_1 to the Nth DC/DC converter 107_N, in accordance with signals from the photosensor 108. The power control circuit 106 is formed using a micro processing unit (MPU), for example.

The first DC/DC converter 107_1 to the Nth DC/DC converter 107_N are circuits that can supply a different current to each of the first light-emitting panel 109_1 to the Nth light-emitting panel 109_N under the control of the power control circuit 106. The first DC/DC converter 107_1 to the Nth DC/DC converter 107_N are each formed using a non-isolated or isolated type DC/DC converter, for example.

The photosensor 108 is a circuit for measuring the external light illuminance or the illuminance in the vicinity of the light-emitting device when light is emitted from the first light-emitting panel 109_1 to the Nth light-emitting panel 109_N, by absorbing visible light. The photosensor 108 is formed using an element with an amorphous silicon p-i-n junction, for example.

The first light-emitting panel 109_1 to the Nth light-emitting panel 109_N are each a panel including a light-emitting layer between an anode and a cathode. A current flowing from the anode side to the cathode side causes the light-emitting layer to emit light. Note that the anode, the cathode, and the light-emitting layer are included in an EL element, in which a hole-injection layer, a hole-transport layer, the light-emitting layer, an electron-transport layer, an electron-injection layer, and the like can be stacked between the anode and the cathode. Alternatively, each of the first light-emitting panel 109_1 to the Nth light-emitting panel 109_N may include a plurality of EL elements having a light-emitting layer between an anode and a cathode.

Figure 2:
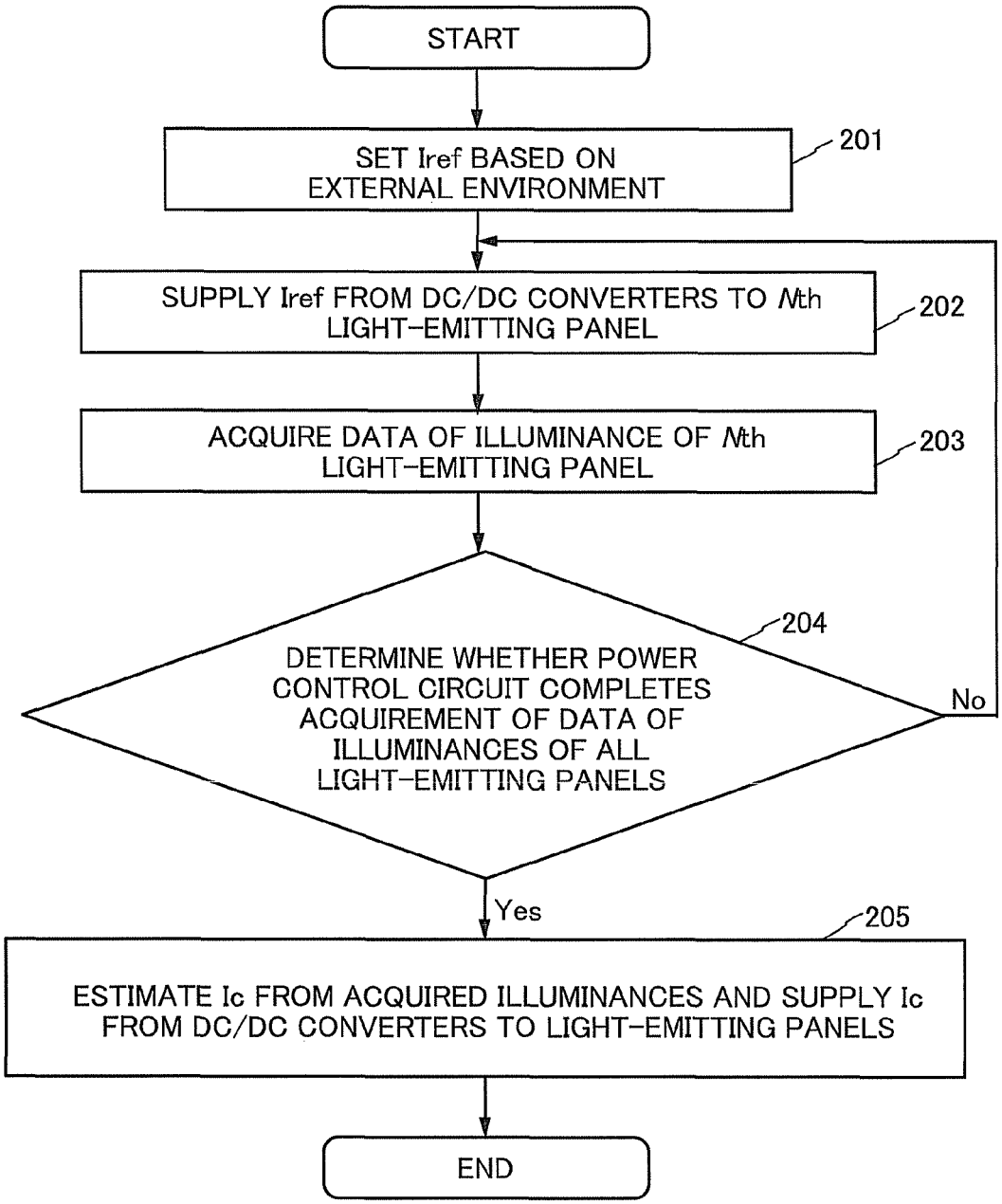
FIG. 2 is a flow chart illustrating a configuration in Embodiment 1.

FIG. 2 is a flow chart of a method of driving the light-emitting device 10 illustrated in FIG. 1. In addition, FIGS. 3A to 3C, FIGS. 4A and 4B, FIGS. 5A and 5B, and FIG. 6 are schematic views illustrating specific operations of the light-emitting device 10 which are described with reference to the flow chart in FIG. 2. Note that the same components are commonly denoted by the same reference numerals in FIG. 1, FIGS. 3A to 3C, FIGS. 4A and 4B, FIGS. 5A and 5B, and FIG. 6.

Figure 3A:
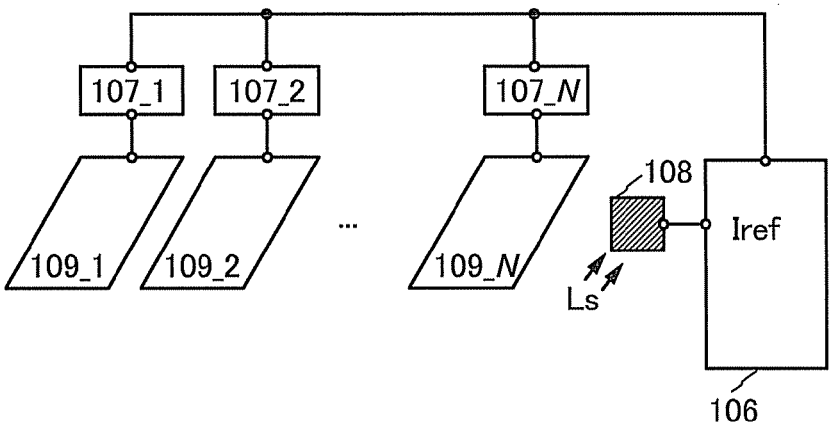
FIGS. 3A to 3C are block diagrams illustrating a configuration in Embodiment 1.

First, in a step 201 in FIG. 2, a reference current Iref is set in accordance with the external environment. A specific operation is as follows: the photosensor 108 measures an illuminance Ls in the vicinity of the light-emitting unit 102; data of the illuminance Ls obtained with the photosensor 108 is input to the power control circuit 106; and in accordance with the level of the illuminance Ls, the power control circuit 106 sets the reference current Iref, which is to be supplied to each of the first light-emitting panel 109_1 to the Nth light-emitting panel 109_N from the corresponding one of the first DC/DC converter 107_1 to the Nth DC/DC converter 107_N. This operation is schematically depicted in FIG. 3A.

The reference current Iref is set in accordance with the illuminance Ls and can also be set with another sensor used in combination. For example, the reference current Iref may be set with a device such as a timer. With a timer, the operations of the light-emitting device can be combined with light adjustment in accordance with scenes in the morning, evening, and night, for example.

Figure 3B:
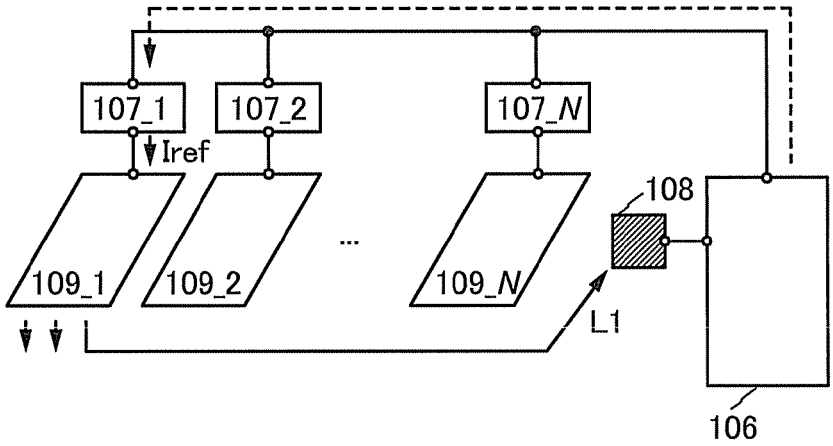

Next, in a step 202 in FIG. 2, under the control of the power control circuit 106, the reference current Iref is supplied from any one of the first DC/DC converter 107_1 to the Nth DC/DC converter 107_N to the corresponding one of the first light-emitting panel 109_1 to the Nth light-emitting panel 109_N. Here, a case is exemplified in which the reference current Iref is first supplied from the first DC/DC converter 107_1 to the first light-emitting panel 109_1. The first light-emitting panel 109_1 emits light as a result of being supplied with the reference current Iref from the first DC/DC converter 107_1. The photosensor 108 measures an illuminance L1 when this light emission occurs from the first light-emitting panel 109_1 (EL1). This operation is schematically shown in FIG. 3B.

Figure 3C:
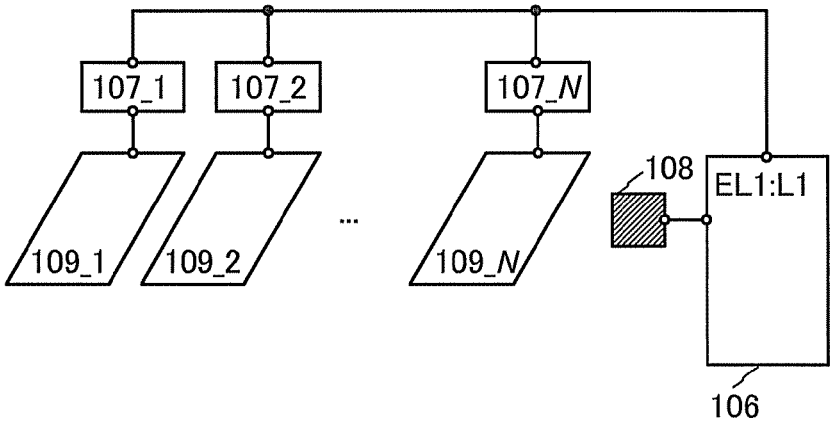

Next, in a step 203 in FIG. 2, the power control circuit 106 acquires data based on the illuminance L1 obtained when light is emitted from the first light-emitting panel 109_1 in the step 202. In sum, in the steps 202 and 203, the reference current Iref is supplied from the first DC/DC converter 107_1 to the first light-emitting panel 109_1 to cause light emission of the first light-emitting panel 109_1 (EL1), and the data based on the illuminance L1 obtained with the photosensor 108 is acquired with the power control circuit 106. This operation is schematically shown in FIG. 3C.

A next step 204 in FIG. 2 is to determine whether or not the power control circuit 106 has acquired the data based on the illuminances after all the individual light-emitting panels are supplied with the reference current Iref from the DC/DC converters and emit light.

If it is determined that the power control circuit 106 has not completed the acquirement of the data based on the illuminances after all the light-emitting panels are supplied with the reference current Iref from the DC/DC converters and emit light, the operation returns to the step 202 in FIG. 2. Described here is an operation after the reference current Iref is supplied from the first DC/DC converter 107_1, the first light-emitting panel 109_1 emits light, and the power control circuit 106 acquires the data based on the illuminance L1.

Figure 4A:
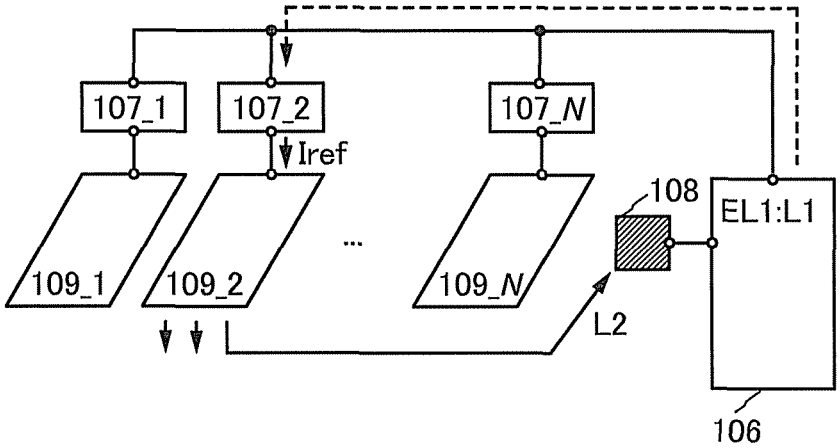
FIGS. 4A and 4B are block diagrams illustrating a configuration in Embodiment 1.

In this case, the following operation is carried out in accordance with the step 202. Specifically, under the control of the power control circuit 106, the reference current Iref is supplied from the second DC/DC converter 107_2 to the second light-emitting panel 109_2, for example. The second light-emitting panel 109_2 emits light as a result of being supplied with the reference current Iref from the second DC/DC converter 107_2. The photosensor 108 measures an illuminance L2 when this light emission occurs from the second light-emitting panel 109_2 (EL2). This operation is schematically shown in FIG. 4A.

Figure 4B:
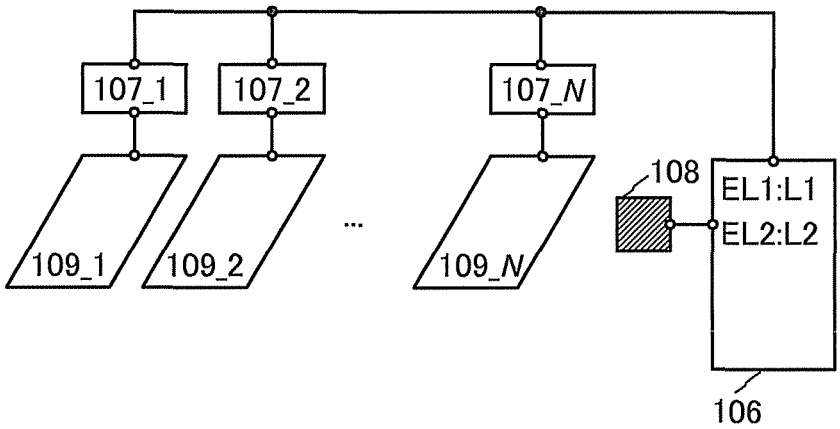

Next, in the step 203, the power control circuit 106 acquires the data based on the illuminance L2 obtained when light is emitted from the second light-emitting panel 109_2 in the step 202. So far, the power control circuit 106 has acquired the data based on the illuminance L1, which is obtained by the supply of the reference current Iref to the first light-emitting panel 109_1, and the illuminance L2, which is obtained by the supply of the reference current Iref to the second light-emitting panel 109_2. This operation is schematically shown in FIG. 4B.

When the acquisition of the illuminances with all the light-emitting panels is still not completed in the step 204, the operation returns to the step 202 in FIG. 2. By repeating these operations, the reference current Iref is supplied from the first DC/DC converter 107_1 to the Nth DC/DC converter 107_N to the first light-emitting panel 109_1 to the Nth light-emitting panel 109_N.

Figure 5A:
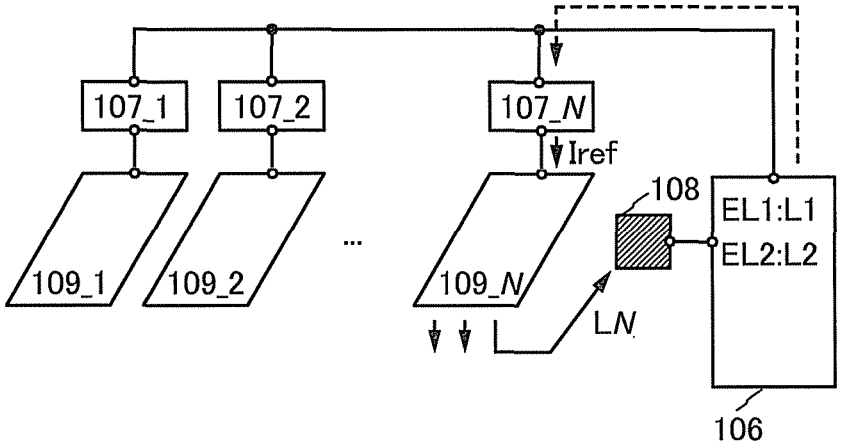
FIGS. 5A and 5B are block diagrams illustrating a configuration in Embodiment 1.

In the case where the reference current Iref is supplied from the Nth DC/DC converter 107_N to the Nth light-emitting panel 109_N, the following operation is also carried out in accordance with the step 202. Specifically, under the control of the power control circuit 106, the reference current Iref is supplied from the Nth DC/DC converter 107_N to the Nth light-emitting panel 109_N. The Nth light-emitting panel 109_N emits light as a result of being supplied with the reference current Iref from the Nth DC/DC converter 107_N. The photosensor 108 measures an illuminance LN when this light emission occurs from the Nth light-emitting panel 109_N (ELN). This operation is schematically shown in FIG. 5A.

Figure 5B:
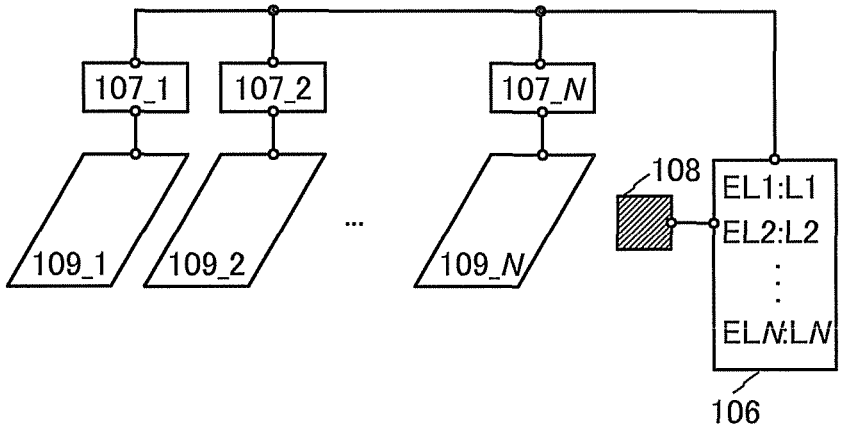

Next, in the step 203, the power control circuit 106 acquires the data based on the illuminance LN obtained when light is emitted from the Nth light-emitting panel 109_N in the step 202. So far, the power control circuit 106 has acquired the data based on the illuminances L1 to LN, which is obtained by the supply of the reference current Iref to all of the first light-emitting panel 109_1 to the Nth light-emitting panel 109_N. This operation is schematically shown in FIG. 5B.

When the power control circuit 106 has acquired the data based on the illuminances after all the light-emitting panels are supplied with the reference current Iref from the DC/DC converters and emit light, the operation proceeds to the step 205 in FIG. 2. Thus, before the step 205, the power control circuit 106 acquires the data based on the illuminances L1 to LN, which are obtained when all of the first light-emitting panel 109_1 to the Nth light-emitting panel 109_N are individually supplied with the same reference current Iref.

By being supplied with the same reference current Iref, the first light-emitting panel 109_1 to the Nth light-emitting panel 109_N are supposed to exhibit the same luminance and enable the same illuminances L1 to LN to be acquired as long as the light-emitting panels have the same current-luminance characteristics. However, a plurality of light-emitting panels has significantly different current-luminance characteristics when they each have a large size and employs an EL element. When such light-emitting panels each including an EL element are combined into one light-emitting device, the difference in luminance of the panels is conspicuous due to the significant differences of current-luminance characteristics. Such a luminance dispersion is reflected in differences of the illuminances L1 to LN obtained when the reference current Iref is supplied to all of the first light-emitting panel 109_1 to the Nth light-emitting panel 109_N in the above-described steps 201 to 204.

Figure 6:
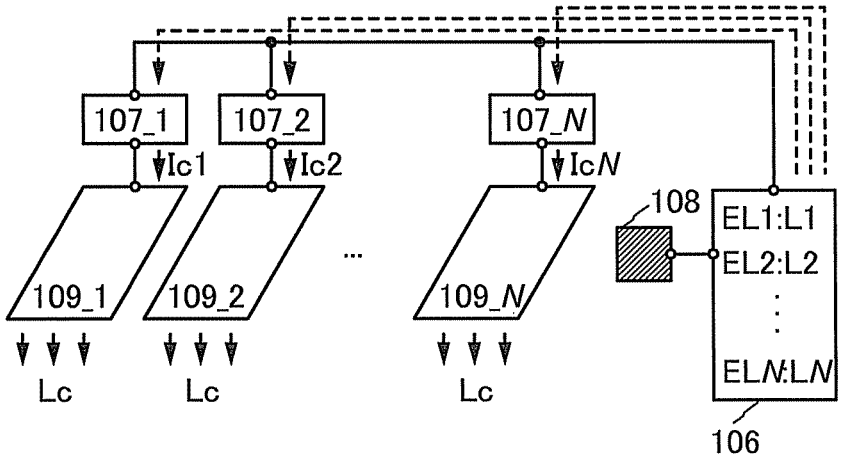
FIG. 6 is a block diagram illustrating a configuration in Embodiment 1.

Therefore in the step 205, corrected currents Ic are estimated from the already acquired illuminances L1 to LN with the light-emitting panels, and are supplied from the first DC/DC converter 107_1 to the Nth DC/DC converter 107_N to the first light-emitting panel 109_1 to the Nth light-emitting panel 109_N. Specifically, a corrected current Ic lower than the reference current Iref can be supplied to a light-emitting panel that provides a higher illuminance than another light-emitting panel, and a corrected current Ic higher than the reference current Iref is supplied to a light-emitting panel that provides a lower illuminance than another light-emitting panel. This operation is schematically shown in FIG. 6.

In the example described with reference to FIGS. 3A to 3C, FIGS. 4A and 4B, FIGS. 5A and 5B, and FIG. 6, a corrected current Ic1, which is corrected to enable the light-emitting panels to provide the same illuminance, is supplied from the first DC/DC converter 107_1 to the first light-emitting panel 109_1 under the control of the power control circuit 106. Further, a corrected current Ic2, which is corrected so as to make the light-emitting panels provide a uniform illuminance, is supplied from the second DC/DC converter 107_2 to the second light-emitting panel 109_2 under the control of the power control circuit 106. In a similar way, a corrected current IcN, which is corrected so as to make the light-emitting panels provide a uniform illuminance, is supplied from the Nth DC/DC converters 107_N to the Nth light-emitting panel 109_N under the control of the power control circuit 106. Consequently, the same illuminance Lc can be obtained with the first light-emitting panel 109_1 to the Nth light-emitting panel 109_N. In other words, the first light-emitting panel 109_1 to the Nth light-emitting panel 109_N can emit light with the same luminance.

The above-described series of operations in the steps 201 to 205 can be started at the time when a light-emitting panel is turned on or at certain periodic intervals. In the series of operations in the steps 201 to 205, the light-emitting panels are preferably switched on and off at such speed that humans cannot perceive these operations. For example, the light-emitting panels are preferably switched on and off at 60 Hz or more, so that the illuminances are measured.

In accordance with one embodiment of the present invention, luminance dispersion of the plurality of light-emitting panels combined into one light-emitting device can be reduced.

This embodiment can be implemented as appropriate in combination with any of the structures described in the other embodiments.

Embodiment 2

This embodiment shows an example of a circuit configuration of the first DC/DC converter 107_1 to the Nth DC/DC converter 107_N, which are described above in Embodiment 1. A circuit configuration of a DC/DC converter 107 and a periphery thereof is specifically illustrated in FIG. 7.

Figure 7:
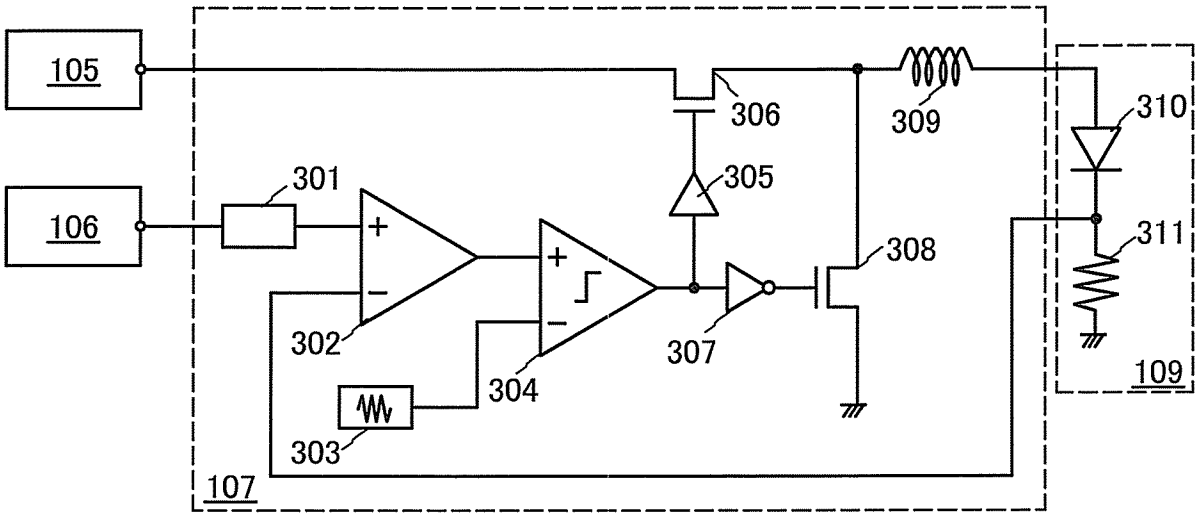
FIG. 7 is a circuit diagram illustrating a configuration in Embodiment 2.

The DC/DC converter 107 illustrated in FIG. 7 includes a D/A converter 301, an error amplifier 302, a triangular-wave generating circuit 303, a comparator 304, a buffer 305, a transistor 306, an inverter 307, a transistor 308, and a coil 309. FIG. 7 illustrates an equivalent circuit of a light-emitting panel 109 as the circuit configuration of the first light-emitting panel 109_1 to the Nth light-emitting panel 109_N, which are described above in Embodiment 1. The light-emitting panel 109 includes a light-emitting element 310 and a sensing resistor 311. FIG. 7 also illustrates the AC/DC converter 105 and the power control circuit 106 described above in Embodiment 1.

In the DC/DC converter 107 in FIG. 7, conversion of a signal from the power control circuit 106 to an analog value is made by the D/A converter 301, followed by input of the converted signal to a non-inverting input terminal of the error amplifier 302. Further, a potential between the light-emitting element 310 and the sensing resistor 311 is input to an inverting input terminal of the error amplifier 302.

An output terminal of the error amplifier 302 is connected to a non-inverting input terminal of the comparator 304. A triangular wave is input from the triangular-wave generating circuit 303 to an inverting input terminal of the comparator 304. An output terminal of the comparator 304 is connected to the buffer 305 and the inverter 307. Further, the buffer 305 controls the conducting state of the transistor 306. The inverter 307 controls the switching of the transistor 308. By the control of the switching of the transistors 306 and 308, a current in accordance with the signal from the power control circuit 106 can be supplied from the AC/DC converter 105 to the light-emitting panel 109.

By adoption of the DC/DC converter 107 described in one embodiment of the present invention as the first DC/DC converter 107_1 to the Nth DC/DC converter 107_N described above in Embodiment 1, luminance dispersion of a plurality of light-emitting panels combined into one light-emitting device can be reduced.

This embodiment can be implemented as appropriate in combination with any of the structures described in the other embodiments.

Embodiment 3

In this embodiment, a simple schematic view of the light-emitting panel 109 described in Embodiment 2 is described with reference to FIG. 8.

Figure 8:
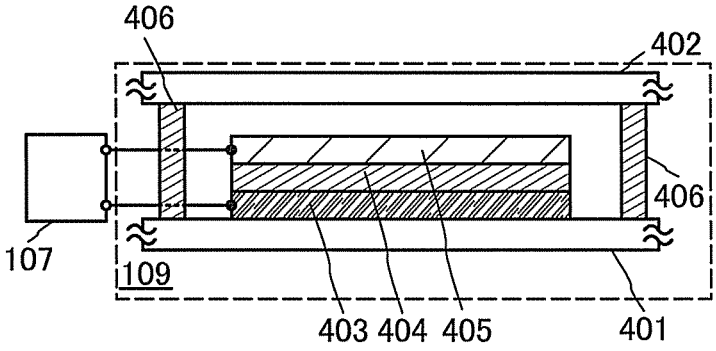
FIG. 8 is a schematic view illustrating a structure in Embodiment 3.

In the light-emitting panel 109 illustrated in FIG. 8, an anode 403, a light-emitting layer 404, and a cathode 405 are stacked between a first substrate 401 and a second substrate 402. Upon application of a voltage between the anode 403 and the cathode 405 through the DC/DC converter 107, holes injected from the anode 403 side and electrons injected from the cathode 405 side are transported and then recombined in the light-emitting layer 404 to excite a light-emitting substance and, when the light-emitting substance returns from the excited state to the ground state, light is emitted. The light-emitting layer 404 functions in this way. The light-emitting layer 404 can be used as a stack with a hole-injection layer, a hole-transport layer, a light-emitting layer, an electron-transport layer, an electron-injection layer, and the like.

The light-emitting layer 404 deteriorates due to the atmosphere including moisture. Therefore the light-emitting layer 404 is preferably prevented from contacting the atmosphere including moisture, with use of the first substrate 401, the second substrate 402, a sealant 406, or the like.

By adoption of the light-emitting panel 109 described in one embodiment of the present invention as the first light-emitting panel 109_1 to the Nth light-emitting panel 109_N described above in Embodiment 1, luminance dispersion of a plurality of light-emitting panels combined into one light-emitting device can be reduced.

This embodiment can be implemented as appropriate in combination with any of the structures described in the other embodiments.

Embodiment 4

In this embodiment, arrangement of the photosensor 108 and the first light-emitting panel 109_1 to the Nth light-emitting panel 109_N in the light-emitting unit 102, which are described in Embodiment 1, is described with reference to FIGS. 9A to 9C.

Figure 9A:
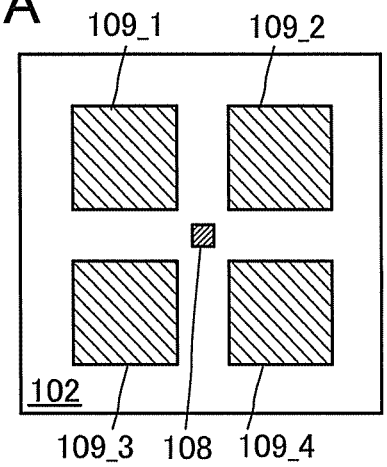
FIGS. 9A to 9C are schematic views illustrating structures in Embodiment 4.
Figure 9B:
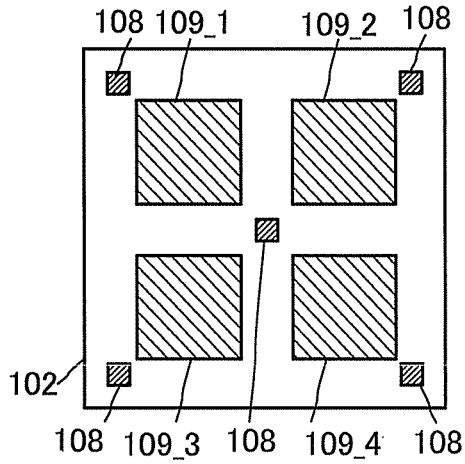
Figure 9C:
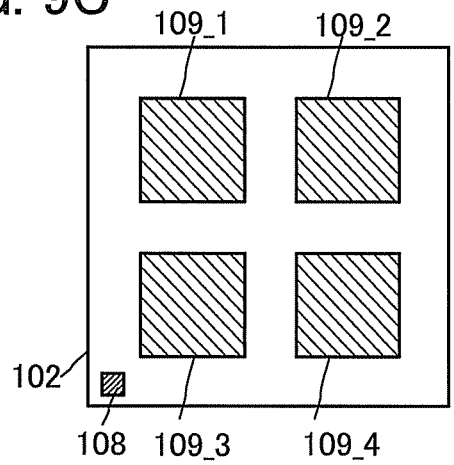

Schematic views of the light-emitting unit 102 in FIGS. 9A to 9C show examples of the arrangement of the photosensor 108 and the first light-emitting panel 109_1 to the fourth light-emitting panel 109_4.

As described above in Embodiment 1, the photosensor 108 selects any one of the first light-emitting panel 109_1 to the fourth light-emitting panel 109_4 and measures the illuminance corresponding to the luminance of the light-emitting panel. Thus, preferably, small dispersion arises in the measured illuminances depending on the locations of the photosensor and the light-emitting panels.

For example, as illustrated in FIG. 9A, the photosensor 108 may be provided at equal distances from the light-emitting panels, the first light-emitting panel 109_1 to the fourth light-emitting panel 109_4. Note that the number of the light-emitting panels in the example in FIG. 9A is four but not limited as long as the photosensor 108 is provided at equal distances from the plurality of light-emitting panels.

In another structure illustrated in FIG. 9B, for example, a plurality of photosensors 108 may be arranged at equal distances from each of the first light-emitting panel 109_1 to the fourth light-emitting panel 109_4, in which case the sum of the illuminances obtained with the plurality of photosensors 108 may be used for the operations described in Embodiment 1. Note that although two photosensors are arranged at equal distances from one light-emitting panel in FIG. 9B, there is no limitation as long as the plurality of photosensors 108 is provided at equal distances from the light-emitting panel.

In another structure illustrated in FIG. 9C, for example, the photosensor 108 may be located at an edge portion of the light-emitting unit 102 where the first light-emitting panel 109_1 to the fourth light-emitting panel 109_4 are provided. In this case, the distance to the photosensor 108 differs among the light-emitting panels, which affects the illuminances obtained with the photosensor 108. Hence in the structure in FIG. 9C, the observed illuminances may be corrected in accordance with the distance differences, and the operations described in Embodiment 1 are performed.

By adoption of the light-emitting panel 109 described in one embodiment of the present invention as the first light-emitting panel 109_1 to the Nth light-emitting panel 109_N described above in Embodiment 1, luminance dispersion of a plurality of light-emitting panels combined into one light-emitting device can be reduced.

This embodiment can be implemented as appropriate in combination with any of the structures described in the other embodiments.

Embodiment 5

In this embodiment, application examples of the light-emitting device of one embodiment of the present invention are described.

Figure 10A:
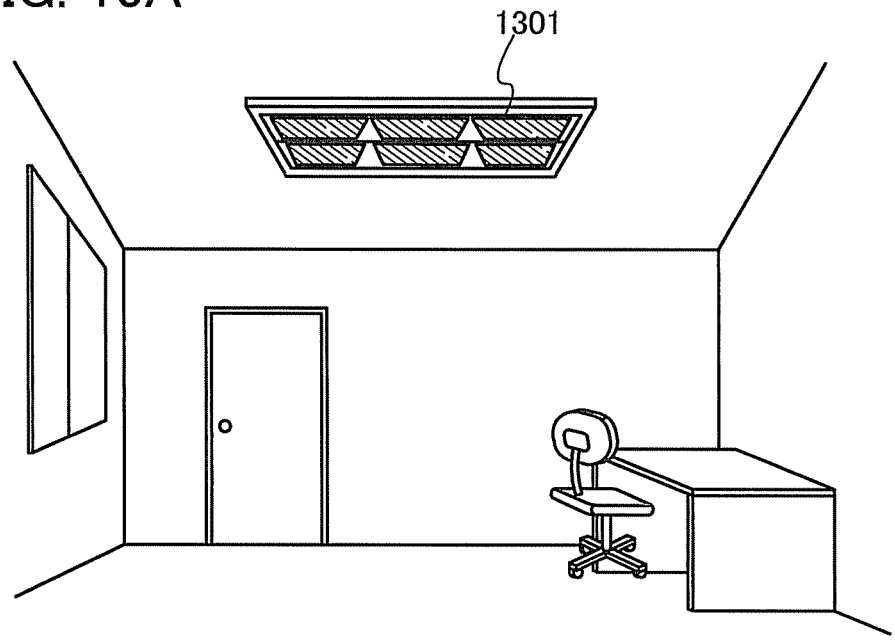
FIGS. 10A and 10B are views illustrating structures in Embodiment 5.

FIG. 10A illustrates an example in which the light-emitting device of one embodiment of the present invention is used as an indoor lighting device 1301.

Since the light-emitting device of one embodiment of the present invention has a planar light source, it requires fewer components than a lighting device using a point light source (e.g., a light-reflecting plate can be omitted), and generates less heat than an incandescent lamp, for example. Thus the light-emitting device of one embodiment of the present invention is preferred as an indoor lighting device.

Figure 10B:
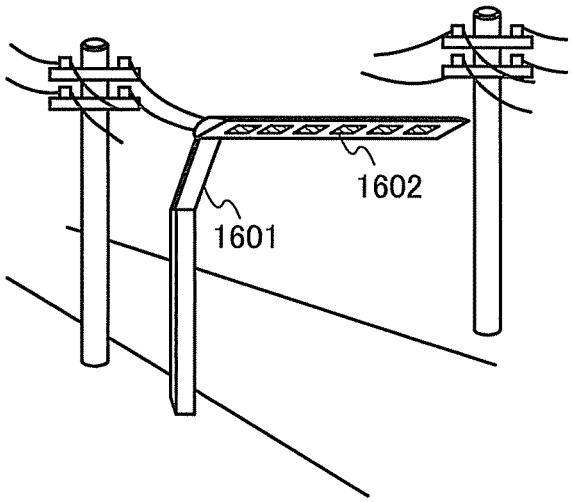

FIG. 10B illustrates an example in which the light-emitting device of one embodiment of the present invention is applied to an outdoor lighting device.

An example of an outdoor lighting device is a street lamp. For example, a street light can include a support 1601 and a lighting device 1602, as illustrated in FIG. 10B. For the lighting device 1602, a plurality of light-emitting devices of one embodiment of the present invention can be used. As illustrated in FIG. 10B, for example, the street light can be provided along a road so as to uniformly illuminate the surroundings with the lighting device 1602, so that the visibility of the surroundings including the road can be increased.

This embodiment can be implemented as appropriate in combination with any of the structures described in the other embodiments.

This application is based on Japanese Patent Application serial no. 2011-269719 filed with the Japan Patent Office on Dec. 9, 2011, the entire contents of which are hereby incorporated by reference.

What is claimed is:

1. A light-emitting device comprising:

first to Nth light-emitting panels, wherein N is a natural number larger than 1;

first to Nth DC/DC converters, wherein the ith DC/DC converter is configured to supply an output current to the ith light-emitting panel, where i is a natural number arbitrarily selected from 1 to N;

a photosensor configured to estimate illuminances of the first to Nth light-emitting panels when the same output current is supplied to the first to Nth light-emitting panels; and a power control circuit configured to acquire data of the illuminances and control output currents of the first to Nth DC/DC converters on the basis of the acquired data.

2. The light-emitting device according to claim 1, wherein the power control circuit is further configured to control the output currents so that the first to Nth light-emitting panels emit light with the same luminance.

3. The light-emitting device according to claim 1, further comprising a plurality of photosensors.

4. The light-emitting device according to claim 1, wherein the ith light-emitting panel comprises a plurality of light emitting elements.

5. The light-emitting device according to claim 1, wherein the photosensor is further configured to estimate external light illuminance.

6. The light-emitting device according to claim 1, wherein the photosensor is arranged so that a distance between the photosensor and each of the first to Nth light-emitting panels is equal.

7. A lighting device comprising the light-emitting device according to claim 1.

8. A light-emitting device comprising:

first to Nth light-emitting panels, wherein N is a natural number larger than 1;

first to Nth DC/DC converters, wherein the ith DC/DC converter is electrically connected to the ith light-emitting panel where i is a natural number arbitrarily selected from 1 to N;

a power control circuit electrically connected to the first to Nth DC/DC converters; and a photosensor electrically connected to the power control circuit, wherein the power control circuit is configured to control a current which is output from the ith DC/DC converter to the ith light-emitting panels.

9. The light-emitting device according to claim 8, wherein:

the power control circuit is configured to control the first to Nth DC/DC converters so that the first to Nth DC/DC converters supply the same output current to the first to Nth light-emitting panels, the photosensor is configured to estimate illuminances of the first to Nth light-emitting panels at the same output current, and the power control circuit is further configured to acquire data of the illuminances so that the control of the current output from the ith DC/DC converter to the ith light-emitting panel is performed on the basis of the acquired data to allow the first to Nth light-emitting panels to emit light with the same luminance.

10. The light-emitting device according to claim 8, further comprising a plurality of photosensors.

11. The light-emitting device according to claim 8, wherein the ith light-emitting panel comprises a light emitting element.

12. The light-emitting device according to claim 8, wherein the ith light-emitting panel comprises a plurality of light emitting elements.

13. The light-emitting device according to claim 8, wherein the photosensor is further configured to estimate external light illuminance.

14. The light-emitting device according to claim 8, wherein the photosensor is arranged so that a distance between the photosensor and each of the first to Nth light-emitting panels is equal.

15. A lighting device comprising the light-emitting device according to claim 8.

16. A method for driving a light-emitting device, the method comprising the steps of:

sequentially supplying a reference current to first to Nth light-emitting panels, wherein N is a natural number larger than 1;

sequentially measuring illuminances of the first to Nth light-emitting panels at the reference current; and supplying each of the first to Nth light-emitting panels with a respective corrected current on the basis of the measured illuminances of the first to Nth light-emitting panels at the reference current.

17. The method according to claim 16, wherein the respective corrected current is determined so that the first to Nth light-emitting panels emit light with the same luminance.

18. The method according to claim 16, wherein the reference current is determined in accordance with external light illuminance.

19. The method according to claim 16, wherein the measurement of the illuminances of the first to Nth light-emitting panels is performed by a plurality of photosensors.

20. The method according to claim 16, wherein the ith light-emitting panel comprises a plurality of light emitting elements, where i is a natural number arbitrarily selected from 1 to N.

* * * * *